US007908857B2

(12) United States Patent
Nordling

(10) Patent No.: US 7,908,857 B2
(45) Date of Patent: Mar. 22, 2011

(54) ENGINE HAVING A TURBOCHARGER COUPLER

(75) Inventor: Eric A. Nordling, Highland, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 422 days.

(21) Appl. No.: 12/117,244

(22) Filed: May 8, 2008

(65) Prior Publication Data

US 2009/0277172 A1 Nov. 12, 2009

(51) Int. Cl.
*F02B 29/04* (2006.01)
*F01N 3/02* (2006.01)

(52) U.S. Cl. ..... 60/599; 60/320; 60/321; 60/323

(58) Field of Classification Search ..... 60/599, 60/320, 321, 323; 417/406–409
See application file for complete search history.

(56) References Cited

U.S. PATENT DOCUMENTS 2,886,945 A * 5/1959 Hofer ..... 60/321
2,954,763 A * 10/1960 Malcolm ..... 60/323
3,169,365 A * 2/1965 Benjamen ..... 60/321
4,179,884 A * 12/1979 Koeslin ..... 60/321
6,176,082 B1 * 1/2001 Shaffer ..... 60/321

FOREIGN PATENT DOCUMENTS

DE 10336978 B3 * 1/2005

* cited by examiner

*Primary Examiner* — Thomas E Denion
*Assistant Examiner* — Mary A Davis
(74) *Attorney, Agent, or Firm* — Harness, Dickey & Pierce, P.L.C.

(57) ABSTRACT

A turbo assembly may include a coupling member, a heat shield, and a turbo mechanism. The coupling member may include first and second ends and an annular body extending between the first and second ends. The first end may fix the coupling member to an exhaust manifold of an engine and the annular body may define an exhaust gas channel that receives exhaust gas from the exhaust manifold. The annular body may include a coolant passage that receives a coolant fluid. The heat shield may extend axially within the exhaust gas channel and radially between the annular body and an exhaust gas flow within the exhaust gas channel to limit an amount of heat transferred from the exhaust gas to the annular body. The turbo mechanism may include a housing fixed to the second end of the coupling member and in communication with the exhaust gas channel to receive the exhaust gas therefrom.

20 Claims, 4 Drawing Sheets

ENGINE HAVING A TURBOCHARGER COUPLER

FIELD

The present disclosure relates to engine assemblies, and more specifically to turbo couplings for engine assemblies.

BACKGROUND

The statements in this section merely provide background information related to the present disclosure and may not constitute prior art.

Engine assemblies may incorporate the use of turbochargers to compress the air flowing into the engine to provide a greater amount of air to each cylinder. In order to compress the air flow into the engine, the turbocharger uses exhaust flow from the engine to spin a turbine, which in turn spins an air pump (or compressor). Since the turbine is in communication with the exhaust gas, temperatures of the turbine can be very high. As a result, a large amount of heat may be transferred to components, such as an exhaust manifold, that are coupled to the turbine.

SUMMARY

A turbo assembly may include a coupling member, a heat shield, and a turbo mechanism. The coupling member may include first and second ends and an annular body extending between the first and second ends. The first end may fix the coupling member to an exhaust manifold of an engine and the annular body may define an exhaust gas channel that receives exhaust gas from the exhaust manifold. The annular body may include a coolant passage that receives a coolant fluid. The heat shield may extend axially within the exhaust gas channel and radially between the annular body and an exhaust gas flow within the exhaust gas channel to limit an amount of heat transferred from the exhaust gas to the annular body. The turbo mechanism may include a housing fixed to the second end of the coupling member and in communication with the exhaust gas channel to receive the exhaust gas therefrom.

An engine assembly may include an exhaust manifold, a coupling member, a heat shield, and a turbo mechanism. The exhaust manifold may include an outlet and the coupling member may include first and second ends and an annular body extending between the first and second ends. The first end may fix the coupling member to the outlet of the exhaust manifold. The annular body may define an exhaust gas channel that receives exhaust gas from the exhaust manifold. The annular body may include a coolant passage that receives a coolant fluid. The heat shield may extend axially within the exhaust gas channel and radially between the annular body and an exhaust gas flow within the exhaust gas channel to limit an amount of heat transferred from the exhaust gas to the annular body. The turbo mechanism may include a housing fixed to the second end of the coupling member and in communication with the exhaust gas channel to receive the exhaust gas therefrom.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
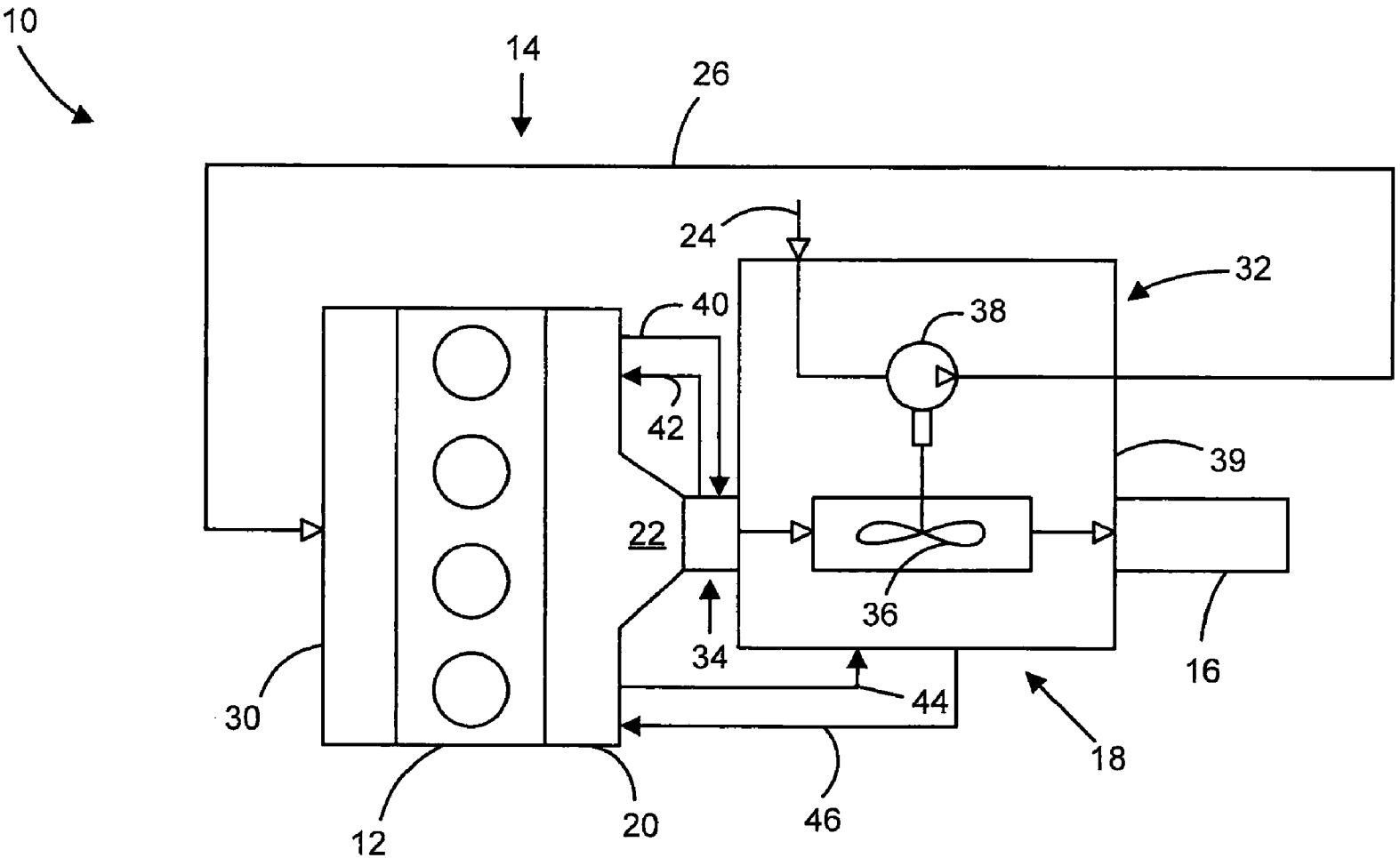
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, an exemplary engine assembly 10 is schematically illustrated. The engine assembly 10 may include an engine 12 in communication with an intake system 14, an exhaust system 16, and turbo assembly 18. In the example shown, the engine 12 may include a cylinder head 20 having an integrated exhaust manifold 22. The integrated exhaust manifold 22 may be part of a single casting that forms the cylinder head 20 and may direct exhaust gas from the engine 12 to the turbo assembly 18.

The intake system 14 may include a first intake conduit 24 supplying air to the turbo assembly 18, a second intake conduit 26 in communication with the turbo assembly 18 and an intake manifold 30 in communication with the second intake conduit 26 and receiving the compressed air from the turbo assembly 18. The exhaust system 16 may be in communication with the turbo assembly 18 and may direct exhaust gas from the turbo assembly 18.

The turbo assembly 18 may include a turbo mechanism 32 and a coupling assembly 34. The turbo mechanism 32 may include a turbine 36 and a compressor 38 located within a turbo housing 39. The turbine 36 may be in communication with and driven by the exhaust gas from the engine 12. The compressor 38 may be in communication with the first intake conduit 24 and may be driven by the turbine 36. Supply and return lines 40, 42 may place the coupling assembly 34 in communication with a coolant fluid from the engine 12. Additional supply and return lines 44, 46 may place the turbo mechanism 32 in communication with a coolant fluid from the engine 12.

Figure 2:
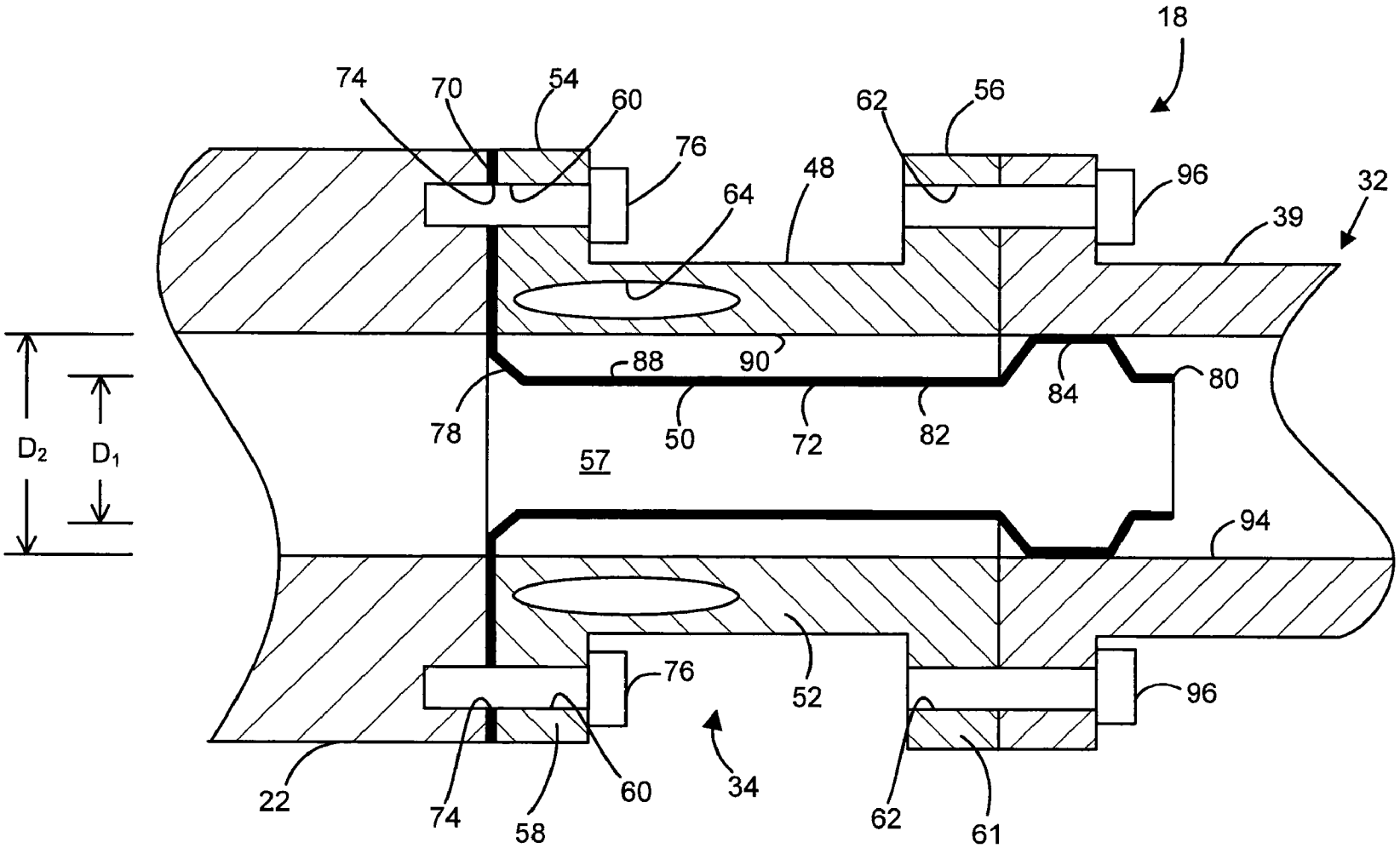
FIG. 2 is a schematic illustration of a turbo assembly shown in FIG. 1.
Figure 3:
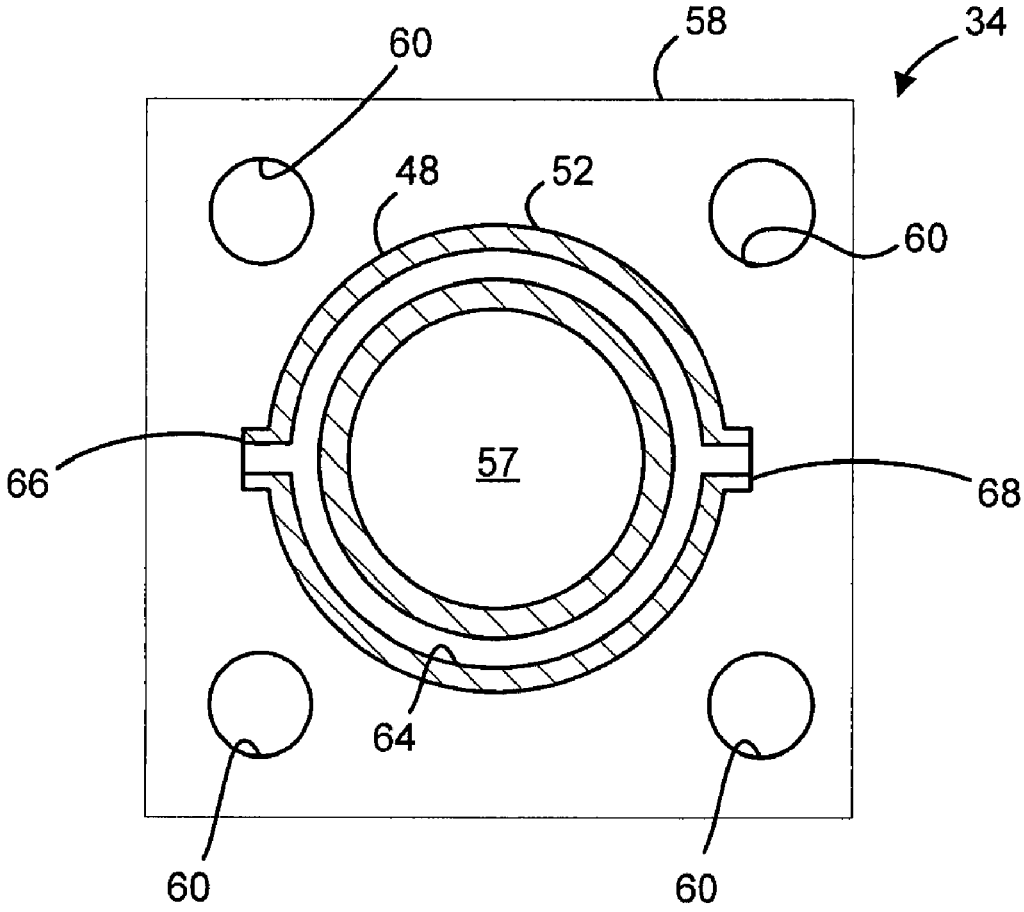
FIG. 3 is an additional schematic illustration of a coupling assembly shown in FIG. 2.

With reference to FIGS. 2 and 3, the coupling assembly 34 may include a coupling member 48 and a heat shield 50. The coupling member 48 may include an annular body 52 extending between first and second ends 54, 56. The annular body 52 defines an exhaust gas channel 57 therethrough. The first end 54 may include a first radially outwardly extending flange 58 having a series of apertures 60 extending therethrough and the second end 56 may include a second radially extending flange 61 having a series of apertures 62 extending therethrough. The annular body 52 may include a coolant passage 64 in communication with the coolant supply and return lines 40, 42. As seen in FIG. 3, the coolant passage 64 may form an annular passage (or loop) within the annular body 52. The annular body 52 may have a coolant inlet 66 in communication with the coolant supply line 40 and an outlet 68 in communication with the coolant return line 42. The coolant passage 64 may extend around an entire circumference of the coupling member 48. More specifically, the coolant passage 64 may extend around an entire circumference of the annular body 52.

The heat shield 50 is disposed in the exhaust gas channel 57 and may include a radially extending flanged portion 70 and an axially extending body portion 72. The flanged portion 50 may be located axially between the coupling member 48 and the exhaust manifold 22 and may include apertures 74 aligned with the apertures 60 in the coupling member 48. The apertures 60, 74 may receive fasteners 76 that engage the exhaust manifold 22 to fix the coupling assembly 34 to the engine 12. The heat shield 50 may be formed from stainless steel and the flanged portion 70 may form a gasket between the exhaust manifold 22 and the coupling member 48.

The body portion 72 of the heat shield 50 may extend axially from the flanged portion 70 into the coupling member 48 toward the turbo mechanism 32. The body portion 72 may include a first end 78 that is generally fixed axially at the flanged portion 70 and a second end 80 generally opposite the first end 78 and generally free from axial restraint. The body portion 72 may include first and second portions 82, 84 along the axial extent thereof.

The first portion 82 may extend from the first end 78 and may be axially aligned with the coolant passage 64 in the coupling member 48. The first portion 82 may have an outer surface 88 that is offset radially inwardly relative to an inner surface 90 of the coupling member 48, forming an air gap radially between the heat shield 50 and the coupling member 48. The air gap may be axially aligned with the coolant passage 64. More specifically, the outer diameter ($D_1$) of the outer surface 88 of the heat shield 50 may be less than the inner diameter ($D_2$) of the coupling member 48, forming an annular air gap therebetween.

The second portion 84 may be located proximate the second end 80 of the body portion 72 of the heat shield 50. The second portion 84 may extend into the housing 39 of the turbo mechanism 32 and may abut an inner surface 94 of the housing 39 to radially secure the second end 80. The housing 39 of the turbo mechanism 32 may be fixed to the second radially extending flange 61 of the coupling member 48 with fasteners 96. Alternatively, the second portion 84 may be located within the coupling member 48 and may engage the inner surface 90. In either situation, the second portion 84 may be located axially downstream of the coolant passage 64.

During engine operation, the air gap provided between the heat shield 50 and the coupling member 48 may reduce the amount of heat transferred from the exhaust gas to the coupling member 48. As such, the heat rejection to the coolant within the coolant passage 64 from the exhaust gas may be reduced. The second portion 84 of the heat shield 50 may support the second end 80 of the heat shield 50 to improve fatigue characteristics and to reduce vibration of the heat shield 50. The freedom of the second end 80 from axial constraint may accommodate thermal growth of the heat shield 50.

Figure 4:
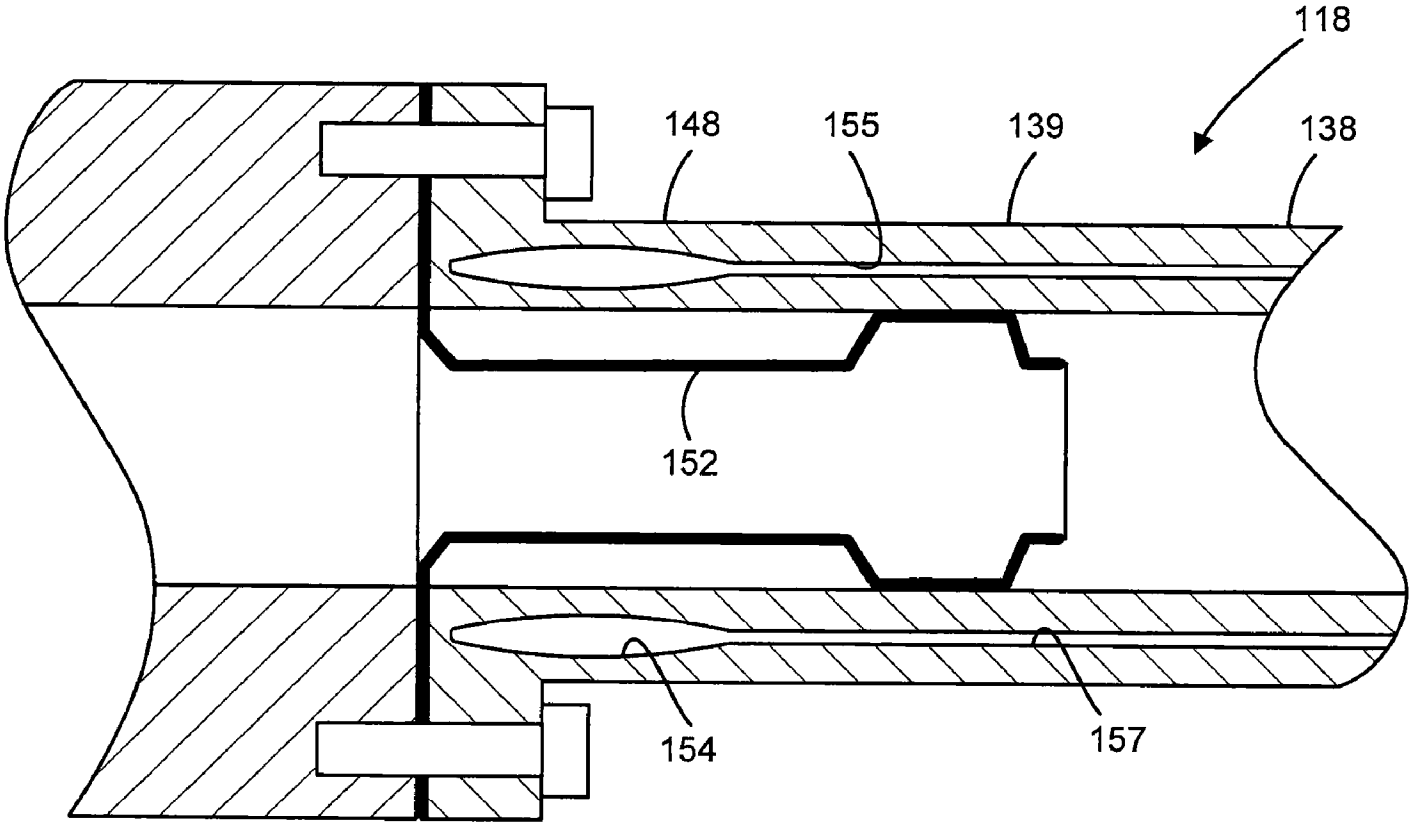
FIG. 4 is a schematic illustration of an alternate turbo assembly according to the present disclosure.

An alternate turbo assembly 118 is shown in FIG. 4. It is understood that the turbo assembly 118 may be generally similar to the turbo assembly 18 with the exception of the features discussed below. The turbo assembly 118 may include a housing 139 having a turbo mechanism portion 138, a coupling portion 148 that is integrally formed therewith and a heat shield 152. The coupling portion 148 may be generally similar to the coupling member 48. Additional coolant passages 155, 157 may extend from the coolant passage 154 into the turbo housing 139 so that a single set of coolant lines (not shown), similar to the supply line 44 and the return line 46 in FIG. 1 may be used to feed both the coolant passage 154 in the coupling portion 148 as well as coolant passages (not shown) in the turbo mechanism portion 138.

What is claimed is:

1. A turbo assembly comprising:

a coupling member including first and second ends and a first annular body extending between the first and second ends, the first end being adapted to fix the coupling member to an exhaust manifold of an engine and the first annular body defining an exhaust gas channel that receives exhaust gas from the exhaust manifold, the first annular body including a coolant passage therein that receives a coolant fluid;

a heat shield extending axially within the exhaust gas channel to limit an amount of heat transferred from the exhaust gas to the first annular body; and a turbo mechanism including a housing fixed to a second end of the coupling member and in communication with the exhaust gas channel to receive the exhaust gas therefrom.

2. The turbo assembly of claim 1, wherein the coolant passage in the first annular body is an annular coolant passage forming a loop in the first annular body.

3. The turbo assembly of claim 1, wherein the first end of the coupling member includes a first flange that is adapted to fix the coupling member to the exhaust manifold, the heat shield including a first end disposed axially outwardly from the first flange and overlying the first flange to form a gasket between the coupling member and the exhaust manifold.

4. The turbo assembly of claim 3, wherein a second end of the heat shield is free from axial restraint to allow for thermal expansion of the heat shield.

5. The turbo assembly of claim 3, wherein a second end of the heat shield includes a radially outwardly extending portion that radially secures the heat shield within the exhaust gas channel.

6. The turbo assembly of claim 1, wherein the heat shield includes an axially extending second annular body, a portion of the second annular body being radially offset from a radially inner surface of the first annular body.

7. The turbo assembly of claim 6, wherein the radial offset forms an air gap radially between the heat shield and the coupling member.

8. The turbo assembly of claim 7, wherein the air gap is axially aligned with the coolant passage.

9. The turbo assembly of claim 1, wherein the coupling member is integrally formed with the housing of the turbo mechanism.

10. An engine assembly comprising:

an exhaust manifold including an outlet;

a coupling member including first and second ends and a first annular body extending between the first and second ends, the first end fixing the coupling member to the outlet of the exhaust manifold, the first annular body defining an exhaust gas channel that receives exhaust gas from the exhaust manifold, a coolant passage being defined within the first annular body that receives a coolant fluid;

a heat shield extending axially within the exhaust gas channel to limit an amount of heat transferred from the exhaust gas to the first annular body; and a turbo mechanism including a housing fixed to a second end of the coupling member and in communication with the exhaust gas channel to receive the exhaust gas therefrom.

11. The engine assembly of claim 10, wherein the coolant passage in the first annular body is an annular coolant passage that forms a loop in the first annular body.

12. The engine assembly of claim 10, wherein the first end of the coupling member includes a first flange that fixes the coupling member to the exhaust manifold and the heat shield includes a first end disposed axially outwardly from the first flange and overlying the first flange to form a gasket between the coupling member and the exhaust manifold.

13. The engine assembly of claim 12, wherein a second end of the heat shield is free from axial restraint to allow for thermal expansion of the heat shield.

14. The engine assembly of claim 12, wherein a second end of the heat shield includes a radially outwardly extending portion that radially secures the heat shield within the exhaust gas channel.

15. The engine assembly of claim 10, wherein the heat shield includes an axially extending second annular body, a portion of the second annular body being radially offset from a radially inner surface of the first annular body.

16. The engine assembly of claim 15, wherein the radial offset forms an air gap radially between the heat shield and the coupling member.

17. The engine assembly of claim 16, wherein the air gap is axially aligned with the coolant passage.

18. The engine assembly of claim 10, wherein the exhaust manifold is integrally formed with a cylinder head of the engine assembly.

19. The engine assembly of claim 18, wherein the exhaust manifold and the cylinder head are formed from a single casting.

20. The engine assembly of claim 10, wherein the coupling member is integrally formed with the housing of the turbo mechanism.

* * * * *